United States Patent [19]

Rubin

[11] Patent Number: 4,585,558

[45] Date of Patent: Apr. 29, 1986

[54] SEPARATION SYSTEM

[75] Inventor: Leslie S. Rubin, Newton, Mass.

[73] Assignee: Foster-Miller, Inc., Waltham, Mass.

[21] Appl. No.: 652,322

[22] Filed: Sep. 19, 1984

[51] Int. Cl.[4] ..... B04B 7/16

[52] U.S. Cl. ..... 210/360.1; 210/378; 494/4; 494/5; 494/36

[58] Field of Search ..... 494/4, 5, 36; 210/360.1, 378

[56] References Cited

U.S. PATENT DOCUMENTS

| | | | |
|---|---|---|---|
| 1,995,926 | 3/1935 | Kirby | 68/15 |
| 2,106,986 | 2/1938 | Pearce | 494/4 |
| 2,120,139 | 6/1938 | Tholl | 494/4 |
| 3,311,236 | 3/1967 | Hurst | 210/360.1 |
| 3,377,019 | 4/1968 | Cox | 494/4 |
| 3,497,385 | 2/1970 | Steele et al. | 494/5 |
| 3,647,135 | 3/1972 | Mercier | 494/36 |
| 3,658,179 | 4/1972 | Baumann | 210/66 |
| 3,946,940 | 3/1976 | Tadokoro | 494/36 |
| 3,955,754 | 5/1976 | Schaper | 494/36 |
| 4,061,480 | 12/1977 | Frye | 55/356 |
| 4,111,355 | 9/1978 | Ishimaru | 233/20 |
| 4,234,449 | 11/1980 | Wolson | 252/301 |

FOREIGN PATENT DOCUMENTS

| | | | |
|---|---|---|---|
| 638298 | 2/1928 | France | 494/36 |
| 1209955 | 1/1966 | France | 494/36 |
| 1089355 | 11/1967 | United Kingdom | 494/36 |

OTHER PUBLICATIONS

"Donaldson HIPAC Centrifuge", Donaldson Company, Inc., Technical Information, P.O. Box 1299, Minneapolis, Minn. 59440.

*Primary Examiner*—Tim Miles

[57] ABSTRACT

A separation system for dewatering radioactive waste materials includes a disposal container, drive structure for receiving the container, and means for releasably attaching the container to the drive structure. Separation structure disposed in the container adjacent the inner surface of the side wall structure retains solids while allowing passage of liquids. Inlet port structure in the container top wall is normally closed by first valve structure that is centrifugally actuated to open the inlet port and discharge port structure at the container periphery receives liquid that passes through the separation structure and is normally closed by second valve structure that is centrifugally actuated to open the discharge ports. The container also includes coupling structure for releasable engagement with the centrifugal drive structure. Centrifugal force produced when the container is driven in rotation by the drive structure opens the valve structures, and radioactive waste material introduced into the container through the open inlet port is dewatered, and the waste is compacted. The ports are automatically closed by the valves when the container drum is not subjected to centrifugal force such that containment effectiveness is enhanced and exposure of personnel to radioactive materials is minimized.

18 Claims, 8 Drawing Figures

FIG 3
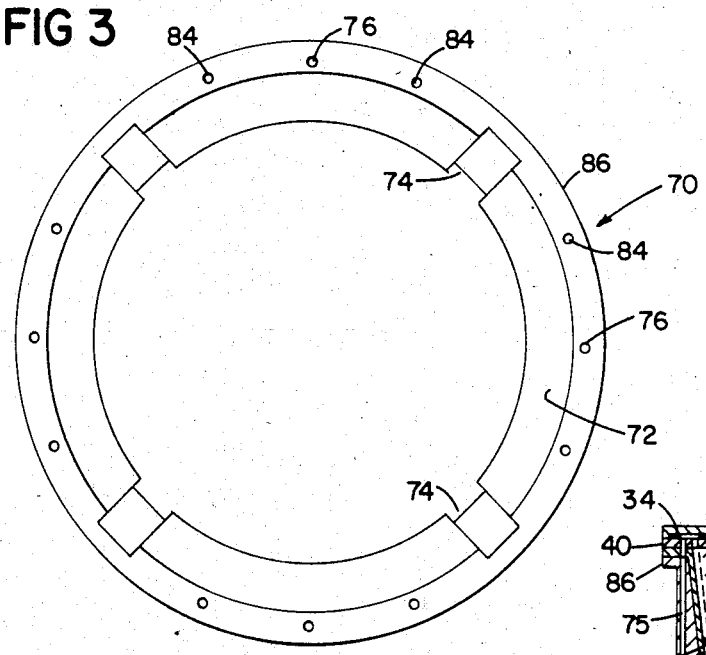
FIG 5
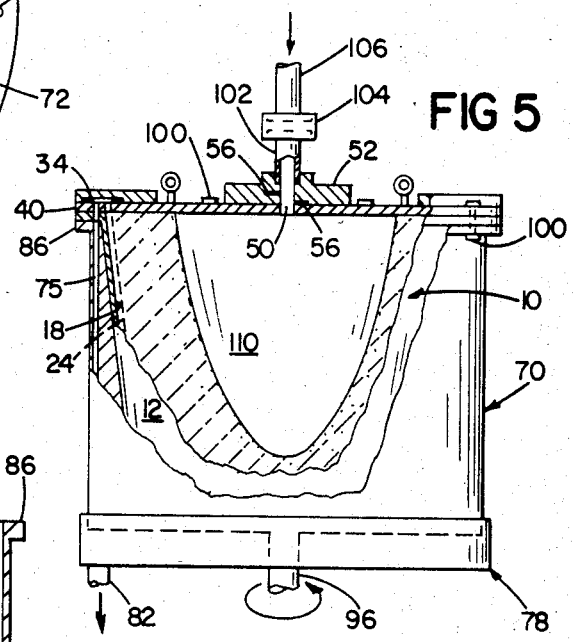
FIG 4
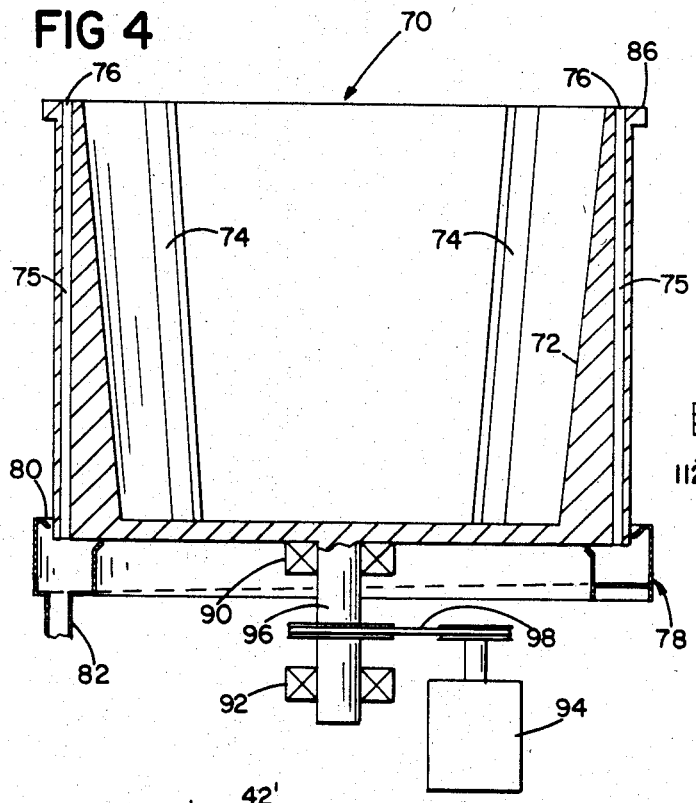
FIG 6
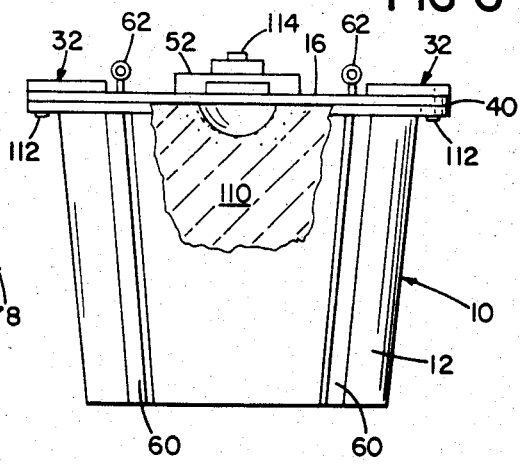
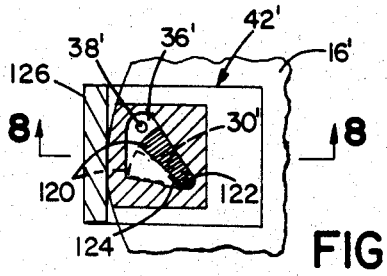
FIG 7
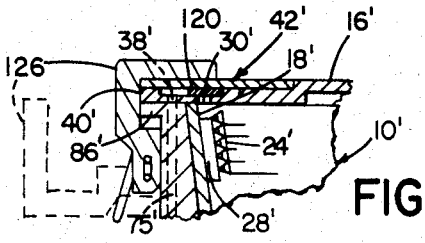
FIG 8

SEPARATION SYSTEM

This invention relates to separation systems and more particularly to systems for separation of liquids from solids such as radioactive waste materials that are produced, for example, in connection with the operation of a nuclear power plant.

The disposal of radiactive waste presents significant economic and environmental challenges. For example, the disposal of spent resin waste from a single nuclear power plant using present disposal technology can cost more than one million dollars per year. In accordance with present federal regulations, spent resin low level radioactive waste must have its free water content reduced to less than one half weight percent before the dewatered waste may be buried for storage in order to minimize the threat of future contamination of soil or ground water at the burial site.

A principal technique of preparing low level spent resin for burial disposal presently utilizes drum filtration technology in which an external pump draws liquid from the bottom of a drum through perforated pipes. Other preparation technologies include the addition of a solidification agent to the spent resin slurry in sufficient quantity to bind all free water in the resin slurry; and dewatering using a commercial solid bowl centrifuge in which the liquid is disposed at one end of the rotating bowl and the dewatered resin is discharged from the opposite end of the rotating bowl as driven by a conveyor helix.

In accordance with one aspect of the invention, there is provided a disposal container for the disposal of waste radioactive materials, the container comprising top wall and bottom wall structures that are interconnected by circumferential side wall structure to define an enclosed container. Separation structure is disposed in the container adjacent the inner surface of the side wall structure for allowing passage of liquid and retention of solids. Inlet port structure is in the container top wall and discharge port structure at the container periphery is in communication with the outer surface of the separation structure for receiving liquid that passes through the separation structure. First centrifugally actuated valve structure has a normal position closing the inlet port structure and a centrifugally actuated position opening the inlet port structure, and second centrifugally actuated valve structure has a normal position closing the discharge port structure and a centrifugally actuated position opening the discharge port structure. The container also includes coupling structure integral with wall structure of the container for releasable engagement with centrifugal drive structure.

In accordance with another aspect of the invention, there is provided a separation system for dewatering radioactive waste materials that includes a disposal container, drive structure for receiving the container, and means for releasably attaching the container to the drive structure. The container includes top wall and bottom wall structures that are interconnected by circumferential side wall structure to define an enclosed container, and separation structure disposed in the container adjacent the inner surface of the side wall structure allows passage of liquid and retains solids. Inlet port structure in the container top wall is normally closed by first centrifugally actuated valve structure that is centrifugally actuated to open the inlet port and discharge port structure at the container periphery is in communication with the outer surface of the separation structure for receiving liquid that passes through the separation structure and is normally closed by second centrifugally actuated valve structure that is centrifugally actuated to open the discharge ports. The container also includes coupling structure for releasable engagement with the centrifugal drive structure. Drain passage structure in the drive structure is aligned with the container discharge ports for receiving liquid passed through the separation structure under the influence of centrifugal force produced when the container is driven in rotation by the drive structure to subject the container to centrifugal force and open the valve structures. Radioactive waste material is introduced into the container through the open inlet port for dewatering, the water being discharged through the discharge ports, and the waste is compacted during the dewatering process. The ports are automatically closed by the valves when the container drum is not subjected to centrifugal force such that the effectiveness of the containment is enhanced and exposure of personnel to radioactive materials is minimized.

In a particular embodiment, the drive structure includes housing structure into which the container is adapted to be inserted, the housing structure including internal sidewall surfaces for reinforcing engagement with the sidewall structure of the container. The wall structures of the container are of impervious material, the top and bottom walls of the container being sealed to the side wall, and the second centrifugally actuated valve structure includes a plurality of valve elements symmetrically disposed about the periphery of the container. The separation structure in the container includes screen units that extend over substantially the entire inner surface of the side wall structure and are spaced inwardly from the container inner side wall surface to define therebetween liquid flow passages in communication with the discharge port valves at the periphery of the container. The container also includes means for sealing its inlet and discharge port structures.

Other features and advantages will be seen as the following description of particular embodiments progress, in conjunction with the drawings, in which:

FIG. 3 is a top view of centrifuge drive structure for the container shown in FIG. 1;

FIG. 4 is a cross-sectional view of the centrifuge drive structure of FIG. 3;

FIG. 5 is a sectional view showing the separation system in operation;

FIG. 6 is a cross-sectional view, similar to FIG. 1, showing the container filled with spent resin waste and sealed in preparation for burial disposal; and FIGS. 7 and 8 are side and top views showing an alternate form of container valve, transfer channel and clamp structure.

DESCRIPTION OF PARTICULAR EMBODIMENTS

Figure 1:
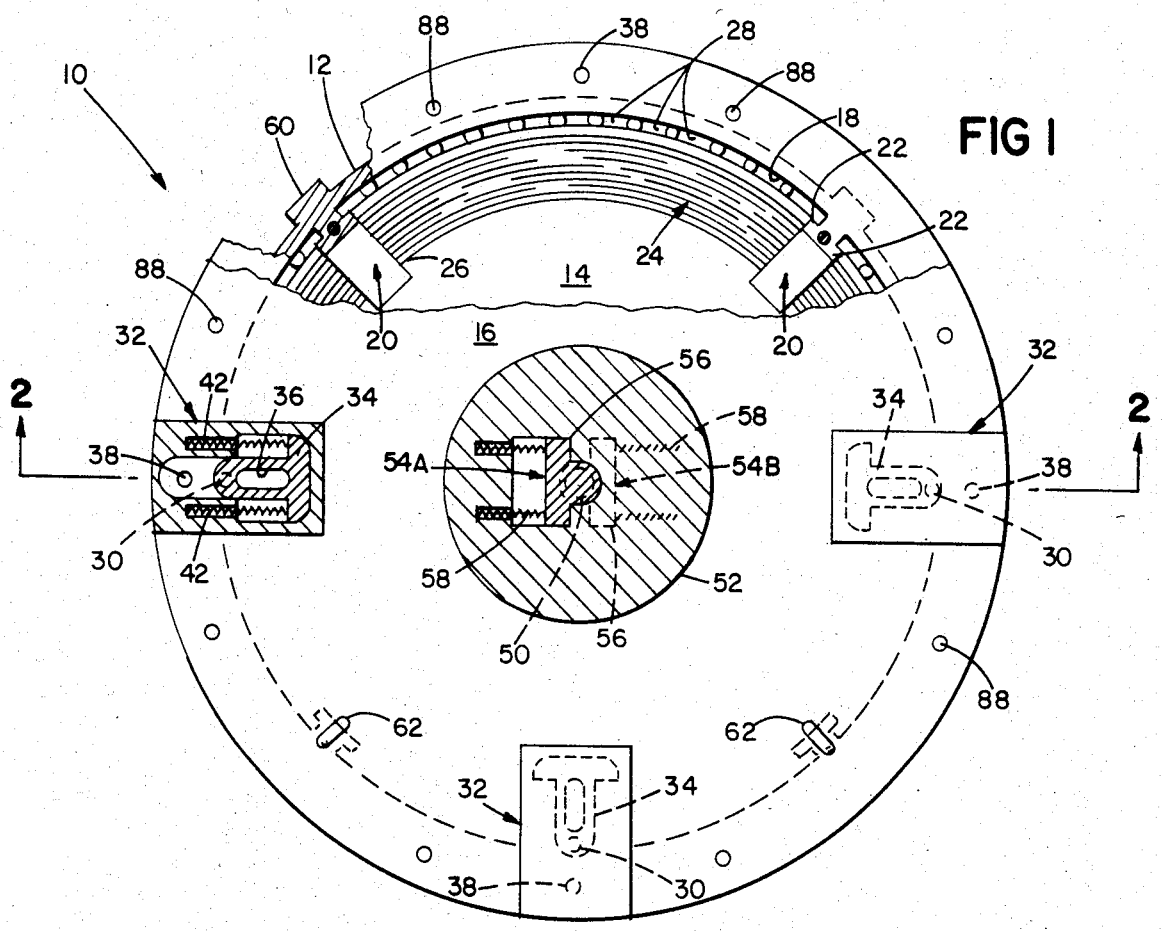
FIG. 1 is a top plan view (with portions broken away) of container structure in accordance with the invention.
Figure 2:
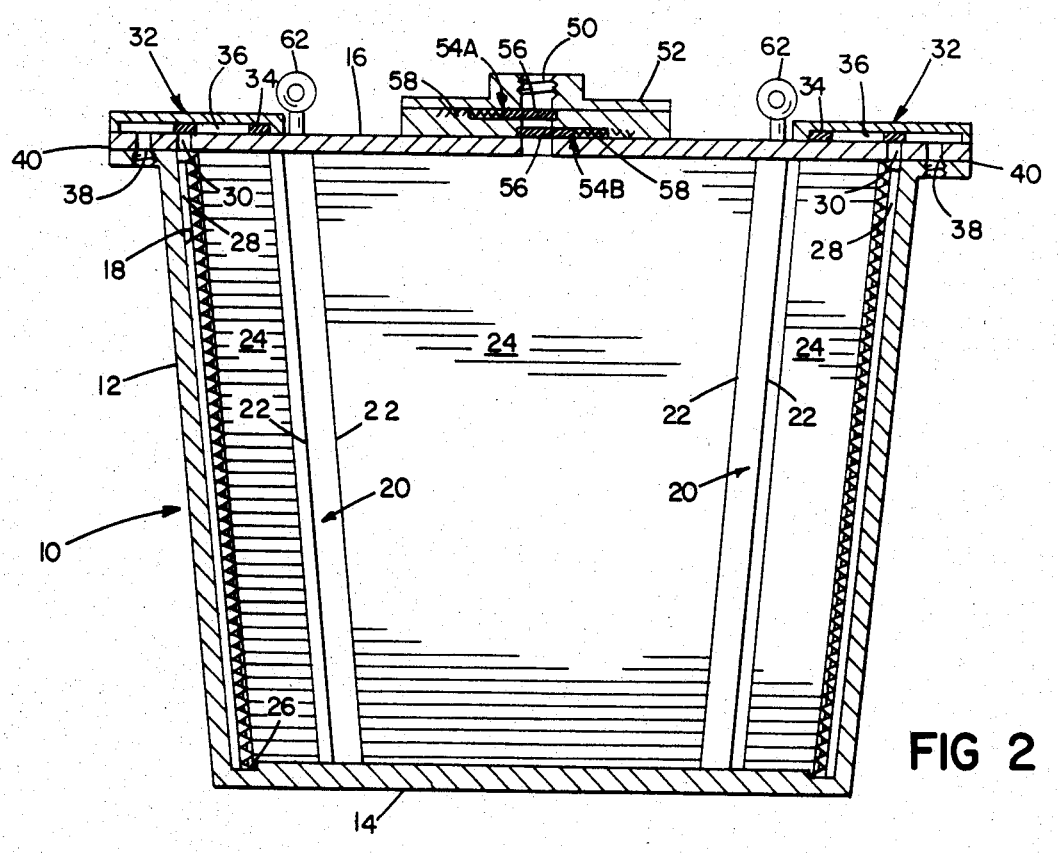
FIG. 2 is a sectional view taken along the line 2—2 of FIG. 1.

The disposal container 10 shown in FIGS. 1 and 2 is of suitable impervious material (depending on the radioactivity of the resin material to be treated) such as steel or high density polyethylene and is about four feet in diameter and about five feet in height. Its circumferential sidewall 12 extends between and is sealed to planar base 14 and planar cover 16. In this embodiment sidewall 12 is inclined at an angle of about five degrees. On the interior surface 18 of sidewall 12 are disposed four spaced centering ribs 20 that have flanges 22 which receive slide-in wedge-wire screen assemblies 24 that extend from lip seal 26 in the base 14 of container 10 to cover 16 and define through passages for liquid but obstruct the passage of solids. Flow channels 28 extend vertically between sidewall surfaces 18 and the wedge wires of the screen assemblies 24.

Ports 30 in cover 16 communicate with flow channels 28, and each is closed by centrifugally actuated gate valve structure 32. Each gate valve structure includes sliding plate 34 in which transfer channel 36 is formed and that is movable between an inner position in which port 30 is closed and an outer position in which transfer channel 36 provides communication between port 30 and discharge port 38 that extends through rim 40 of container 10. Springs 42 bias plates 34 to their inner port closing positions.

Inlet port 50 is centrally located in cover 16 and extends through valve housing 52 in which are disposed two opposed gate valve structures 54A, 54B, each of which includes a sliding plate 56 that is urged to a port closing position by springs 58 and which is opened by centrifugal force.

Aligned with centering ribs 20 on the outer surface of container sidewall 12 are spline members 60. Secured to the container cover 16 at those locations are lifting eyes 62.

Container 10 is arranged to be received in centrifuge housing 70, further details of which may be seen with reference to FIGS. 3 and 4. Housing 70 includes tapered internal sidewall 72 which mates with the external sidewall surface of container sidewall 12 and includes spline channels 74 which receive external splines 60 of container 10. Extending through the housing are vertical drainage channel passages 75 that extend from ports 76 (which include cooperating seals) down to stationery collection trough 78 which has annular lip structure 80 at its upper end that surrounds the lower edge of housing 70 and drainage passage 82 through which the discharged effluent flows for recirculation into the process stream. Holes 84 in the rim 86 of housing 70 receive clamp bolts that extend through corresponding holes 88 in the rim of the container 10 for clamping the container in the housing as indicated in FIG. 5. Housing 70 is supported by suitable bearing assemblies 90, 92 and driven in rotation by suitable drive motor 94 that is connected to housing drive shaft 96 by drive belt 98.

In operation, an empty container 10 is inserted into housing 70 and secured with fasteners 100. In the assembled position, outlet ports 38 of container 10 are aligned with inlet ports 76 of drainage passages 75 of the housing 70. Inlet pipe 102 is threadably attached to inlet port 50 and communicates through rotary joint 104 to stationary feedpipe 106. The assembly of the container 10 and housing 70 is driven in rotation at appropriate speed, for example 400 rpm to subject radwaste resin beads to about 200 g's for dewatering and 700 rpm to subject radwaste resin powder to about 450 g's for dewatering.

When the system is driven in rotation, the valve plates 34, 56 are moved by centrifugal force against the biasing action of springs 42 and 58, plates 34 being moved to position transfer channels 36 to provide communication between container ports 30 and 38, and plates 56 being moved to open inlet passage 50. The resin material 110 to be dewatered is introduced through feedpipe 106 into container 10 and flows radially outward under centrifugal force against the screen wires 24. The screens 24 retain the resin 110 inside while water passes through the screens into the flow channels 28 and flows upwardly along surfaces 18 through outlet ports 30, transfer passages 36 and outlet ports 38 and down through drainage channels 75 into collection trough 78 to discharge passage 82. Feeding of resin 110 continues until the container drum 10 is substantially completely filled with resin material that has been compacted under the centrifugal force. The centrifuging action is then terminated, and valves 32, 54 automatically close. The securing bolts 100 or appropriate clamps are then released allowing the filled drum 10 to be removed from housing 70 via lifting eyes 62 and an empty drum 10 to be inserted. Supplemental sealing of drum ports 38, 50 can be provided by plugs 110, 112, as indicated where desired. The separation system provides efficient dewatering and compaction of radioactive waste in a container system that provides convenient and safer handling of the filled containers and minimizes exposure of personnel to radioactivity.

Other container configurations and other forms of valving and clamping may be employed. For example, the container may have a cylindrical side wall or be of inverted truncated cone in shape, and in such containers the discharge ports ports are in or adjacent to the bottom wall. An alternate form of container, valve and transfer channel structure is shown in FIGS. 7 and 8. In that arrangement, gate valve member 120 is mounted for rotation about pivot post 122 and is biased to a closed position by leaf spring 124. Toggle clamp structure 126 seats container rim 40' against centrifuge housing rim 86'. Under centrifugal force, valve member 120 is pivoted to the dotted line position, opening the transfer channel 36' that extends between ports 30' and 38' and allowing flow of liquid from container 10' to drainage passage 75'. Transfer passage 36' is automatically reclosed by valve plate 120 when the centrifuging action is terminated.

While particular embodiments of the invention have been shown and described, various modifications will be apparent to those skilled in the art and therefore it is not intended that the invention be limited to the disclosed embodiments or to details thereof and departures may be made therefrom within the spirit and scope of the invention.

What is claimed is:

1. A disposal container for use in disposal of radioactive waste materials comprising top wall structure, bottom wall structure, and circumferential side wall structure interconnecting said top and bottom wall structures to define an enclosed container, separation structure in said container adjacent the inner surface of said side wall structure for allowing passage of liquid and retention of solids, inlet port structure in said top wall structure, discharge port structure at the periphery of said container in communication with the outer surface of said separation structure for receiving liquid that passes through said separation structure, first centrifugally actuated valve structure having a normal position closing said inlet port structure and a centrifugally actuated position opening said inlet port structure, second centrifugally actuated valve structure having a normal position closing said discharge port structure and a centrifugally actuated position opening said discharge port structure, and coupling structure integral with wall structure of said container for releasable engagement with centrifugal drive structure.

2. The container of claim 1 wherein the wall structure of said container is of frustoconical configuration and the top of said container is of greater diameter than the bottom of said container.

3. The container of claim 1 wherein said wall structures are of impervious material and said top and bottom wall structures are sealed to said side wall structure.

4. The container of claim 1 wherein said coupling structure includes spline ribs that extend axially along the outer surface of said circumferential side wall structure.

5. The container of claim 1 wherein said second centrifugally actuated valve structure includes a plurality of valve elements symmetrically disposed about the periphery of said container.

6. The container of claim 1 wherein at least one of said centrifugally actuated valve structures has a reciprocating mode of movement between said normal and centrifugally actuated positions.

7. The container of claim 1 wherein at least one of said centrifugally actuated valve structures has an angular mode of movement between said normal and centrifugally actuated positions.

8. The container of claim 1 and further including means for sealing said inlet and discharge port structures.

9. The container of claim 1 wherein said separation structure is of the wedge wire screen type.

10. The container of claim 1 wherein said separation structure extends over substantially the entire inner surface of said side wall structure and is spaced inwardly from said inner surface to define therebetween liquid flow passages in communication with said discharge port structure.

11. The container of claim 10 wherein said wall structures are of impervious material, said top and bottom wall structures are sealed to said side wall structure, and said second centrifugally actuated valve structure includes a plurality of valve elements symmetrically disposed about the periphery of said container.

12. The container of claim 11 and further including means for sealing said inlet and discharge port structures.

13. A separation system comprising a disposal container for use in disposal of radioactive materials comprising top wall structure, bottom wall structure, and circumferential side wall structure interconnecting said top and bottom wall structures to define an enclosed container, separation structure disposed in said container adjacent the inner surface of said side wall structure for retaining solids and allowing passage of liquid, inlet port structure in said top wall structure, discharge port structure at the periphery of said container in communication with the outer surface of said separation structure for receiving liquid that passes through said separation structure, first centrifugally actuated valve structure having a normal position closing said inlet portion structure and a centrifugally actuated position opening said inlet port structure, second centrifugally actuated valve structure having a normal position closing said discharge port structure and a centrifugally actuated position opening said discharge port structure, and coupling structure integral with wall structure of said container for releasable engagement with centrifugal drive structure drive structure for receiving said container, drain passage structure in said drive structure for alignment with said container discharge port structure for receiving liquid passed through said separation structure under the influence of centrifugal force, and means for driving said drive structure in rotation to subject said container to centrifugal force to open said valve structures, and means for releasably attaching said container to said drive structure.

14. The system of claim 13 wherein said drive structure includes housing structure into which said container is adapted to be inserted, said housing structure including internal sidewall surfaces for reinforcing engagement with the sidewall structure of said container.

15. The system of claim 14 wherein said separation structure extends over substantially the entire inner surface of said side wall structure and is spaced inwardly from said inner surface to define therebetween liquid flow passages in communication with said discharge port structure.

16. The system of claim 13 wherein said wall structures of said container are of impervious material, said top and bottom wall structures are sealed to said side wall structure, and said second centrifugally actuated valve structure includes a plurality of valve elements symmetrically disposed about the periphery of said container.

17. The system of claim 16 and further including means for sealing said inlet and discharge port structures of said container.

18. The system of claim 17 wherein said drive structure includes housing structure into which said container is adapted to be inserted, said housing structure including internal sidewall surfaces for reinforcing engagement with the sidewall structure of said container and liquid flow passage structure in communication with said discharge port structure of said container and extending along said housing structure to collection structure.

* * * * *